US008408784B2

(12) United States Patent
Balter

(10) Patent No.: US 8,408,784 B2
(45) Date of Patent: Apr. 2, 2013

(54) WATCH WINDER ASSEMBLY WITH MOVEABLE ATTENTION-ATTRACTING MECHANISM

(76) Inventor: Valentin Balter, Menlo Park, CA (US)

( * ) Notice: Subject to any disclaimer, the term of this patent is extended or adjusted under 35 U.S.C. 154(b) by 219 days.

(21) Appl. No.: 13/066,597

(22) Filed: Apr. 20, 2011

(65) Prior Publication Data

US 2012/0269045 A1 Oct. 25, 2012

(51) Int. Cl.
*G04B 3/00* (2006.01)

(52) U.S. Cl. ..... 368/206; 81/7.5

(58) Field of Classification Search ..... 368/206–208; 81/7.5

See application file for complete search history.

(56) References Cited

U.S. PATENT DOCUMENTS

| | | | | |
|---|---|---|---|---|
| 2,917,955 | A * | 12/1959 | Leger | 81/7.5 |
| 4,057,958 | A | 11/1977 | Wuntch | |
| 5,608,693 | A | 3/1997 | Richards | |
| 5,988,871 | A | 11/1999 | Bonnet | |
| D440,583 | S * | 4/2001 | Greene, Jr. | D15/199 |
| 6,254,270 | B1 | 7/2001 | Agnoff | |
| 6,439,761 | B1 | 8/2002 | Agnoff | |
| 6,964,513 | B1 * | 11/2005 | Agnoff | 368/206 |
| 7,025,495 | B2 * | 4/2006 | Colarieti | 368/206 |
| 7,198,401 | B2 | 4/2007 | Louie | |
| 7,270,474 | B2 | 9/2007 | Agnoff | |
| 7,575,367 | B2 | 8/2009 | Eolf, et al. | |
| 2007/0159929 | A1 * | 7/2007 | Louie | 368/206 |

FOREIGN PATENT DOCUMENTS

EP 2133757 A1 12/2009

* cited by examiner

*Primary Examiner* — Sean Kayes

(57) ABSTRACT

Provided is the assembly of a watch winder with a moveable attention-attracting mechanism driven from the motor of the watch winder through a transmission mechanism. The attention-attracting mechanism comprises a multilink mechanism that includes a device in the form of a human being, wherein the first link is formed as hands, the second link as a body, and the base support as legs. Rotation of the crank may be further transmitted to another attention-attracting mechanism that is formed as a Ferris wheel. According to the second modification, the multilink mechanism is formed as an oil-extracting pump.

16 Claims, 7 Drawing Sheets

WATCH WINDER ASSEMBLY WITH MOVEABLE ATTENTION-ATTRACTING MECHANISM

FIELD OF THE INVENTION

The present invention relates to a watch winder assembly that contains a watch winder used for keeping a mechanical wristwatch in an operating state when the watch is not worn over a period of time and is beyond the capacity of the spring of the winding mechanism. More specifically, the invention relates to a watch winder that consists of a watch winder and a moveable and decorative or attention-attracting mechanism. In addition to the main watch-winding function, the watch winder assembly of the invention may be used for advertising, for attracting the attention of customers or visitors, and for collecting.

BACKGROUND OF THE INVENTION

Self-winding watches have been available for many years and are known for keeping a mechanical wrist watch wound by movements of the hand when the watch is worn. Generally, the winding mechanism of a self-winding watch comprises a rotary pendulum or rotor that is connected by means of a gear transmission mechanism to a winding spring, the energy of which is used for driving the escapement mechanism of the watch. The pendulum rotates about its axis on bearings and is capable of making a partial turn or a full-revolution turn.

When the watch is worn, the winding spring of the watch is wound under the effect of the movements of the wearer's hand. When the spring is completely wound, depending on the type of watch, the spring will have energy sufficient to run the watch for 12 to 48 hours. Some watches can store enough energy for a longer time but eventually will stop unless they are rewound. If a person owns more than one watch for use on different occasions, the unused watches remain unwound. Under such conditions, a watch winder may maintain continuous operation for multiple watches.

A watch winder used for self-winding watches is also needed for reducing wear and tear of the moving parts of the watch because a properly designed watch winder can help to distribute the lubricating oil inside the watch evenly for most of the time. When a watch winds down and stops, the lubricating oil inside the watch tends to settle and clot, losing a certain extent of its viscosity over an extended period of time. As a result, the chance of certain moving parts not being properly lubricated when the watch runs again is much greater, resulting in increased friction and pressure for certain moving parts inside the watch and shortened mechanical life and hampered performance. This explains why certain watches in a retail store that remain unwound for a long time do not perform well even though the watches are new. Thus, it is understood why the use of a watch winder is absolutely necessary for self-winding watches kept in stores, exhibitions, and storage collections.

However, the disadvantage of all existing watch winders is that generally they have a rather unattractive appearance and the structure and design of these devices are focused exclusively on provision of the watch-winding function.

SUMMARY OF THE INVENTION

The present invention consists of adding to a watch winder a mechanism that is driven from a functional kinetic part of the watch winder for moving an attention-attracting object such as an advertisement or a decorative component.

The watch winder assembly of the invention comprises a base that contains a drive motor and support stands for supporting a watch winder driven into rotation from the drive motor, an attention-attracting object, and a transmission mechanism for transmitting movement from the watch winder to the attention-attracting object.

In accordance with one or several aspects of the invention, the base is made in the form of a hollow disk-like body that has a flat upper wall, the outer surface of which is used as a platform for supporting the aforementioned stands and supports for moving parts. The inner surface of the upper wall supports the drive motor and motor control devices, electrical wiring, a preprogrammed chip for controlling the mode of motor operation, and a rotary switch. Watches of different types require setting of the watch winder to different modes of operation such as clockwise rotation, counterclockwise rotation, or a combination of both. Furthermore, each mode may require a different number of turns per day and a different frequency of rotation. Selection of the appropriate operational mode is carried out through the aforementioned rotary switch, and the chip determines the mode of operation.

Since the drive motor, chip, and rotary switch have relatively small dimensions, the remaining part of the base interior may be used for accommodating retractable drawers that can be used for storing documentation or small items such as screws, nuts, jewelry, coins, etc. According to one or several aspects of the invention, it is advantageous to make the retractable drawers in the form of a pair of sectors pivotally installed in the interior of the base and retractable outward by turning around their pivots. For guiding the retractable drawers and closing the motor compartment, the base can be closed with a back cover plate.

The outer surface of the base upper wall supports a stand formed by two posts between which in bearings is installed a shaft that supports a pulley that is driven into rotation by a belt transmission from the drive pulley secured on the output shaft of the motor. The ends of the shaft that extend outside the posts support spring-loaded yokes that hold the strapped watches. Each yoke is placed in a compressed state into a loop formed by the straps of the strapped watches and when released, the yoke expands by its springing force and is tightly pressed to the inner surface of the straps, thus keeping the straps in a tensed condition. In order to prevent slippage of the straps on the yoke, the latter is provided with rubber pads. The yoke is attached to the rotating shaft of the watch winder rotation mechanism.

In addition to the watch winder, the watch winding assembly of the invention also contains an attention-attracting mechanism installed on the upper wall of the base. According to one or several aspects of the invention, the attention-attracting mechanism may be designed in a variety of ways and may serve various purposes, such as advertisements, attraction of customer attention, visitors of shows and exhibition, collectors, etc. A common feature of attention-attracting mechanisms of all modifications is that they are driven from the watch winders and they perform movements.

According to one or several aspects of the invention, an attention-attracting mechanism contains a support stand secured to the base that rotationally supports a second pulley that is driven through a second drive belt from the driven pulley of the watch winder. The mechanism further comprises a crank secured to the shaft of the second pulley, a first link, the first end of which is pivotally connected to the free end of the pulley and the second end of which is pivotally connected to the first end of a second link. The second end of the second link is pivotally connected to the first end of a third link, and the second end of the third link is pivotally connected to the base.

In the above-described modification of the invention, the shaft of the second pulley may transfer rotation to another moving mechanism that also can be used for attracting visitors' attention. For example, this can be a Ferris wheel (also known as an observation wheel or a big wheel) of a relatively large diameter that is supported on the upper end of the second stand and is driven into rotation through a third drive belt and a third pulley which is secured on the shaft of the Ferris wheel. The Ferris wheel is mentioned only as an example and a component that has any other shape can be attached to the shaft of the third pulley.

On the other hand, the linked mechanism composed of the aforementioned first link, second link, and the support of the second link on the base can be shaped in the form of a human being, wherein the first link is shaped as a hand, the second linked is shaped as a body, and the support is shaped as legs. As a result, when the crank rotates, the multilink mechanism performs movements that imitate the figure of a man/women who with his/her hands rotates the Ferris wheel by the crank and the third drive belt, with movements of the body tilting back and forth with each rotation of the crank. In this movement, the legs remain stationary because they form the support that pivotally supports the third link. If necessary, a second stand can be provided with a mechanism for adjusting the tension of the third belt.

According to another aspect of the invention, the aforementioned multilink mechanism can be shaped as an oil-extraction pump, wherein the crank may have its free end in the form of counterweights. The first link imitates the Pitman arm, the second link imitates a walking beam, the end of the walking beam may be shaped as a horse head, and the bridle that connects the horse head with the reciprocating polished rod is made in the form of a flexible rod. In fact, the moving attention-attracting mechanism of the second modification cinematically is the same as the mechanism of the first modification that is used for driving a human-like figure, except that the multilink mechanism contains three pivotally interconnected links instead of two.

DETAILED DESCRIPTION OF THE INVENTION

Figure 1:
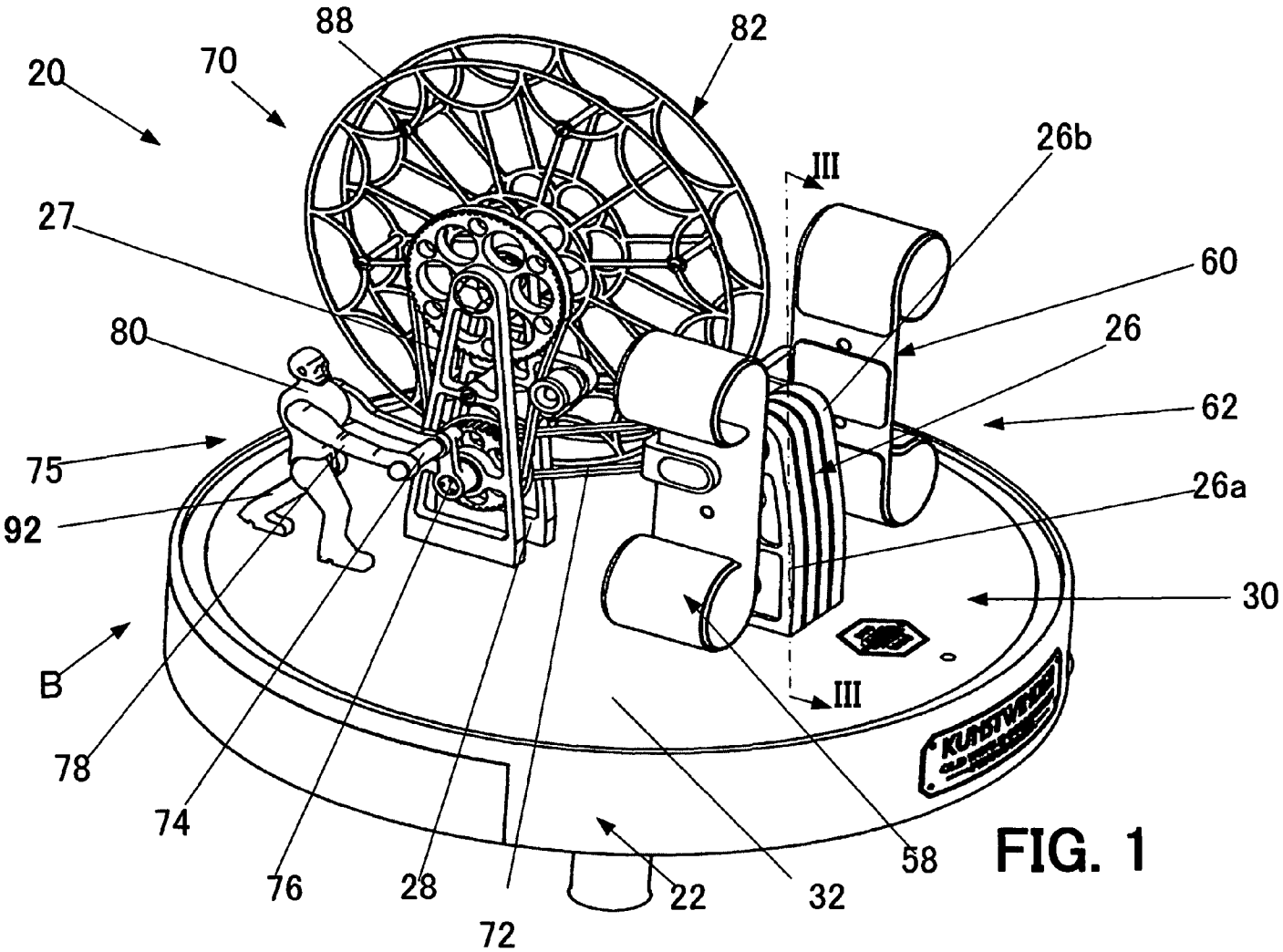
FIG. 1 is a three-dimensional view of the watch winder assembly of the invention with the attention-attracting mechanism having a rotating component.
Figure 2:
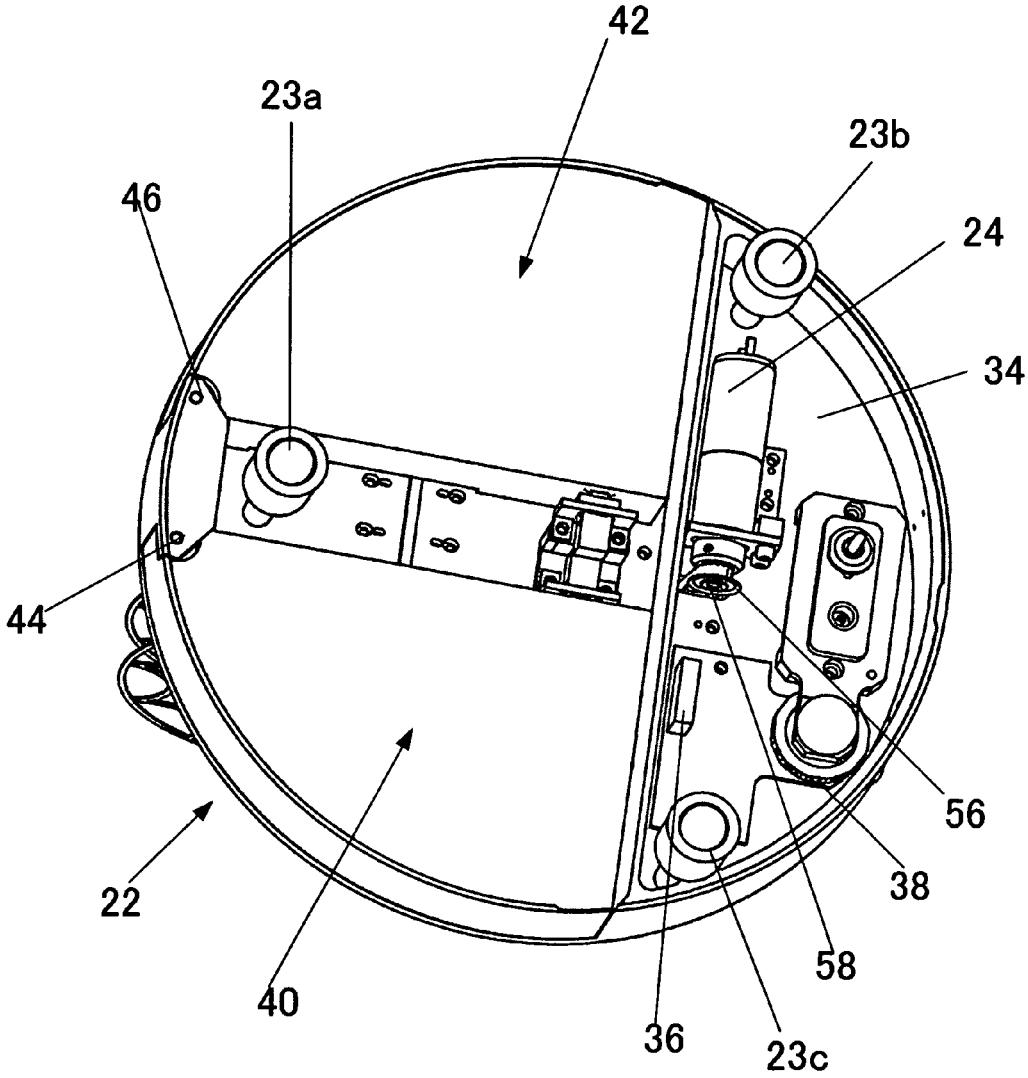
FIG. 2 is a view of the bottom of the base in the direction of arrow A.

A watch winder assembly made in accordance with one aspect of the invention is shown in FIG. 1, which is a three-dimensional view of the assembly; FIG. 2, which is a view of the bottom of the base in the direction of arrow A; and FIG. 3, which is a side view of the assembly of FIG. 1 in the direction of arrow B with a partial cross-section along line III-III of FIG. 1 through the base and a watch winder support stand. If the bottom of the base is closed with a cover plate (not shown), the view in FIG. 2 is a view of the parts located under the cover.

The assembly as a whole is designated by reference numeral 20 and comprises essentially the aforementioned base 22 which contains a drive motor 24 (FIG. 2) and support stands 26*a*, 26*b*, 27, and 28 (FIG. 1) for supporting rotating parts, an attention-attracting object, and a transmission mechanism for transmitting movement of the watch winder to the attention-attracting object, all of which are described below.

In accordance with one or several aspects of the invention, the base 22 is made in the form of a hollow disk-like body that has a flat upper wall 30, the outer surface 32 of which is used as a platform for supporting the aforementioned stands 26*a*, 26*b*, 27 and 28. The inner surface 34 of the upper wall 30 supports the drive motor 24 and motor control devices such as a preprogrammed chip 36 for controlling the mode of motor operation and a rotary switch 38. Watches of different types require setting of the watch winder to different modes of operation such as clockwise rotation, counterclockwise rotation, or a combination of both. Furthermore, each mode may require a different number of turns per day and a different frequency of rotation. Selection of the appropriate operational mode is carried out through the aforementioned rotary switch 38, and the chip 36 (FIG. 2) determines the mode of operation. The switch may comprise a commercially produced component, e.g., SW Rotary SP-2-12POS PC switch manufactured by NKK Switches Company (USA). The chip may comprise IC MAX II CPLD 570 LE 100-TQFP manufactured by Altera Corporation (USA).

Figure 3:
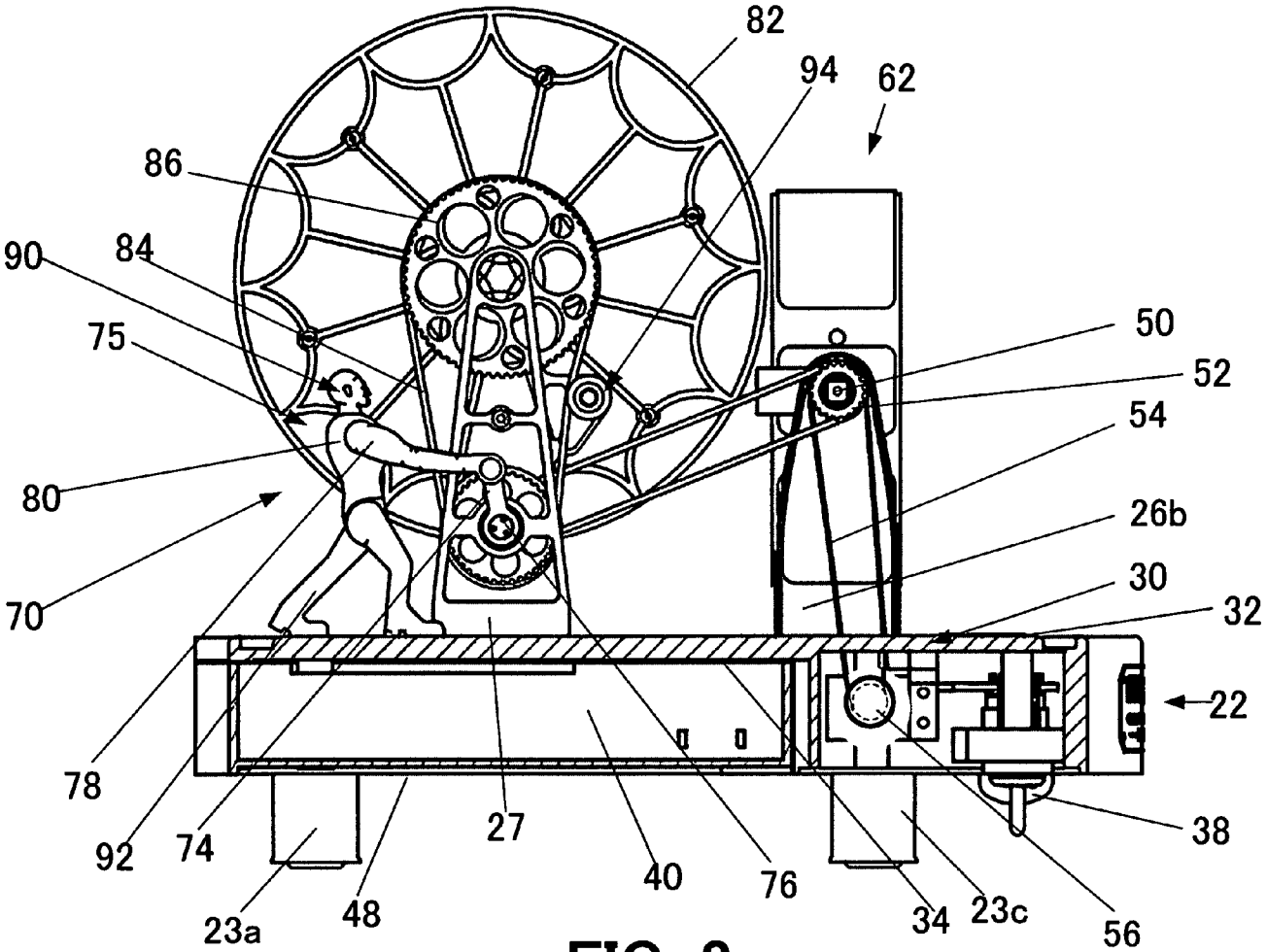
FIG. 3 is a side view of the assembly of FIG. 1 in the direction of arrow B with a partial cross section along line III-III of FIG. 1 through the base and a watch winder support stand.
Figure 4:
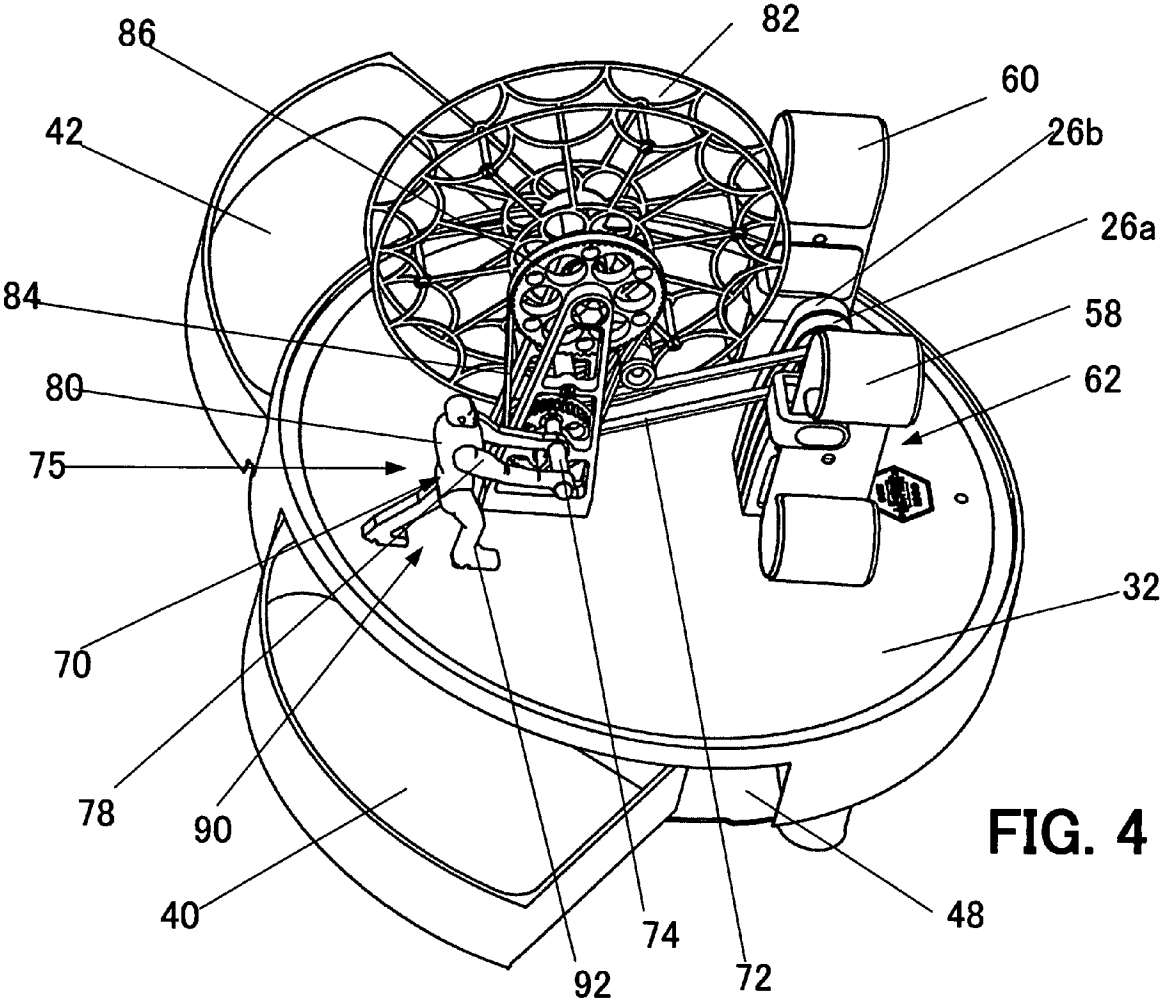
FIG. 4 is a view similar to FIG. 1 with the drawers moved out from the interior of the hollow base.

Since the drive motor 24, chip 36, and rotary switch 38 have relatively small dimensions, the remaining part of the base interior may be used for accommodating retractable drawers 40 and 42 (FIG. 2) which can be used for storing documentation or small items such as screws, nuts, jewelry, coins, etc. According to one or several aspects of the invention, it is advantageous to make the retractable drawers 40 and 42 in the form of a pair of sectors pivotally installed completely in the interior of the base and retractable outward into the position shown in FIG. 4 by turning around their pivots 44 and 46 (FIG. 2). The drawers 40 and 42 in their retracted positions are shown in FIG. 4, which is similar to FIG. 1. For guiding the retractable drawers and closing the motor compartment, the base can be closed with a back cover plate 48 (FIGS. 3 and 4).

As mentioned above, the outer surface 32 of the base upper wall 30 supports the stands 26*a* and 26*b* between which in bearings is installed a shaft (FIG. 3) that supports a driven pulley 52 (FIG. 3) which is driven into rotation by a transmission belt 54 from the drive pulley 56 (FIG. 2) secured on the output shaft 58 of the motor 24. The ends of the shaft that extend outside the posts support spring-loaded yokes 58 and 60 (FIG. 1) that hold the strapped watch. The drive pulley 56, the stands 26*a* and 26*b*, the transmission belt 54, the shaft 52, and the yokes 58 and 60 together form a watch winder, which in general is designated by reference numeral 62 (FIGS. 1, 3, and 4).

Figure 5:
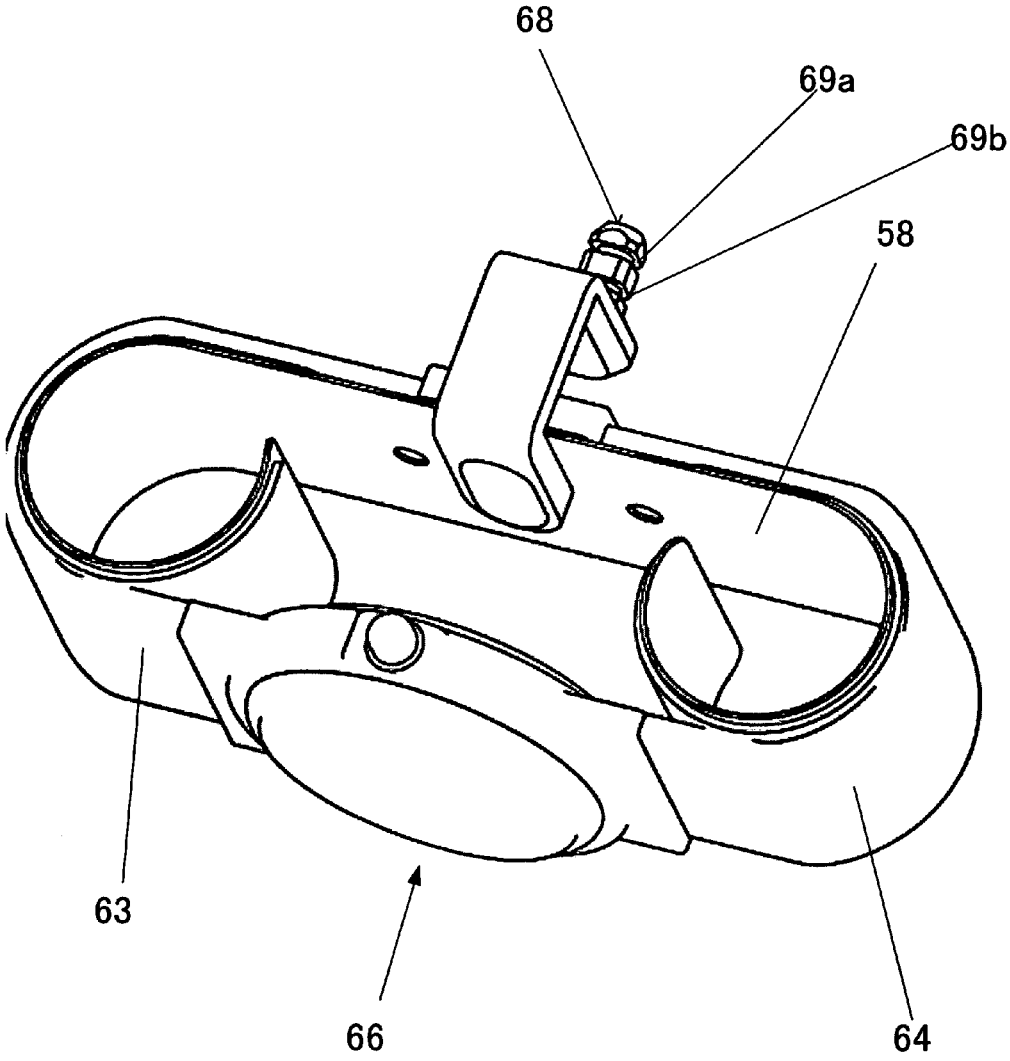
FIG. 5 is a three-dimensional view of a watch holding mechanism of the watch winder of the invention.

A three-dimensional view of the yoke 58 is shown in FIG. 5. Since both yokes are identical, only one will be described. The yoke is made from a material with spring-action properties and in its shape reminds an open loop. The yoke 58 in a compressed state is placed into the loop formed by the straps 63 and 64 of the strapped watches 66; when released, the yoke 58 expands by its springing force and tightly presses to the inner surfaces of the straps 63 and 64 thus keeping them in a tensed condition. In order to prevent slippage of the strapped watches 66 on the yoke 58, the latter is provided with a square pin 68 that is inserted into the driven shaft 50 (FIG. 3) to transmit rotation to the watch holding yoke. On the outer surface of the square pin there are two grooves for O-rings 69*a* and 69*b* that provide friction between the outer surface of the pin and inner surface of the square cutout of the shaft 50.

In addition to the watch winder 62, the watch winding assembly 20 of the invention also contains an attention-attracting mechanism. According to one or several aspects of the invention, the attention-attracting mechanism may be designed in a variety of ways and may serve various purposes such as advertisements, attraction of customer attention, visitors of shows and exhibition, collectors, etc. A common feature of attention-attracting mechanisms of all modifications is that the mechanisms are driven from the watch winders and perform movements. An example of an attention-attracting mechanism, which is designated by reference numeral 70, is shown in FIGS. 1, 3, and 4. This mechanism is installed on the upper wall 30 of the base 22.

According to one or several aspects of the invention, the attention-attracting mechanism 70 contains the aforementioned support stands 27 and 28 (FIG. 1) which are secured to the base 22 and rotationally support a second driven pulley (not shown in the drawings but similar to the driven pulley 52 of the watch winder shown in FIG. 3) which is driven through a second drive belt 72 from the driven pulley of the watch winder. The mechanism further comprises a crank 74 secured to the shaft 76 of the second pulley 52, a first link 78, one end of which is pivotally connected to the free end of the crank and the other end which is pivotally connected to one end of a second link 80. Another end of the second link 80 is pivotally connected to the base 22.

In the above-described modification of the invention, the shaft 76 of the second pulley (not shown) may transfer rotation to another moving mechanism that also can be used for attracting visitors' attention. For example, this can be a Ferris wheel 82 (also known as an observation wheel or big wheel) of relatively large diameter that is rotationally supported by the upper ends of the stands 27 and 28 (FIG. 1) and is driven into rotation through a third drive belt 84 and a third pulley 86 which is secured on the shaft of the Ferris wheel 82. The Ferris wheel 82 is mentioned and shown only as an example, and a component that has any other shape can be attached to the shaft of the third pulley.

On the other hand, the linked mechanism composed of the aforementioned first link 78, second link, and the support of the second link on the base 22 can be shaped in the form of a human being 90 (FIG. 3), wherein the first link 78 is shaped as a hand, the second link 80 is shaped as a body, and the support component 92 is shaped as legs. The support component 92 is rigidly connected to the base 22.

As a result, when the crank 74 rotates, the multilink mechanism 75 (FIG. 3) composed of pivotally connected links perform movements that imitate the figure of a man who with his hands (first link 78) rotates the Ferris wheel by the crank and the third drive belt with movements of the body tilting back and forth with each rotation of the crank. In this movement, the legs remain stationary because they form the aforementioned support 92 that pivotally supports the second link 80. If necessary, the stands 27 and 28 may support a mechanism 94 for adjusting the tension of the third belt 84.

Figure 7:
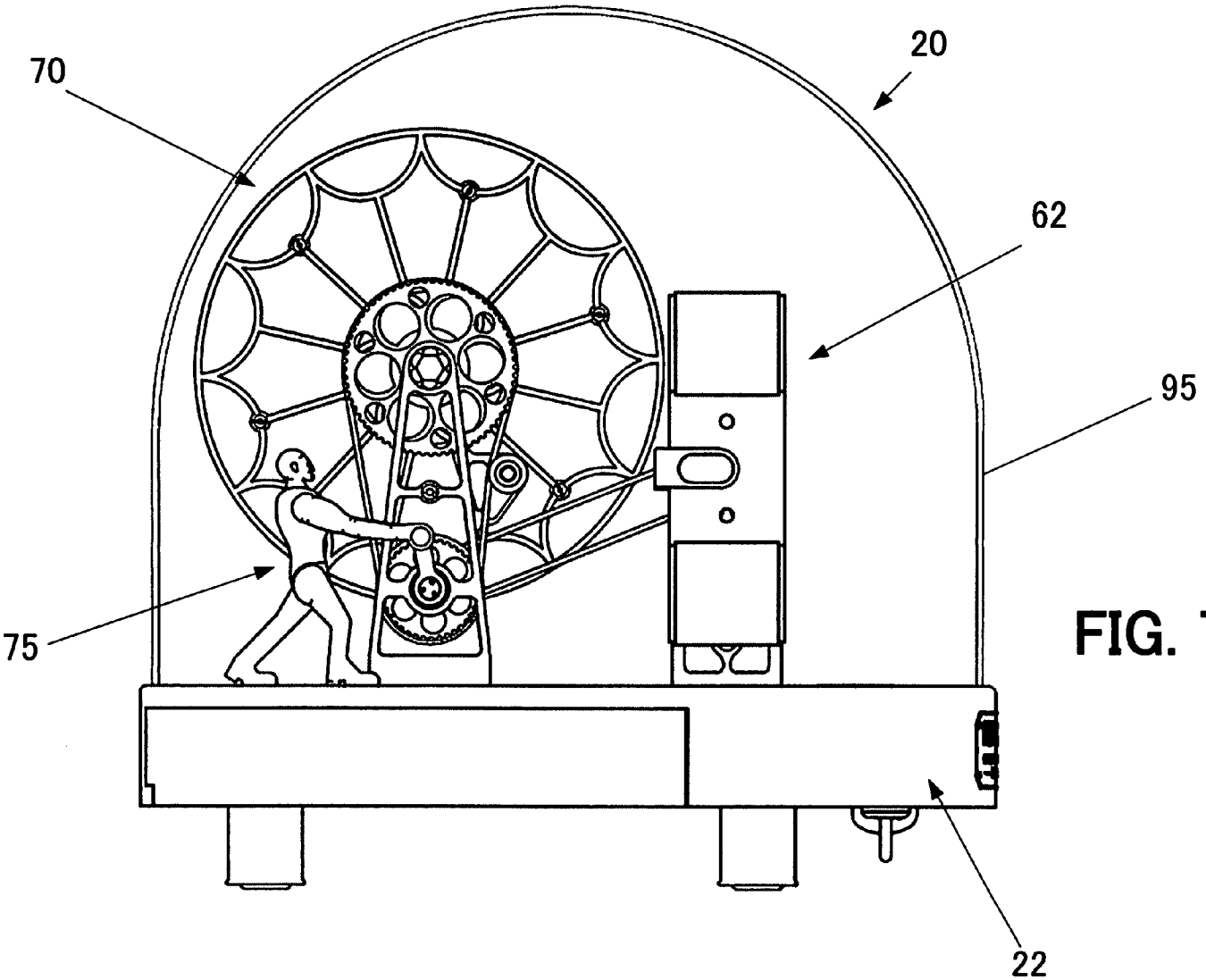
FIG. 7 is a side view of the assembly of FIG. 1 provided with a transparent protective dome that covers all mechanisms.

In order to reduce the load on the drive motor 24 (FIG. 2), the parts of the attention-attracting mechanism should be made from a lightweight material and with the minimal possible thickness. Furthermore, as shown in FIG. 7, a thin dome 95 made from transparent plastic or glass can cover the entire watch winder assembly 20 and the moveable attention-attracting mechanism.

In FIGS. 2, 3, and 4, reference numerals 23*a*, 23*b*, 23*c* designate base supports.

The watch winder assembly with moveable attention-attracting mechanism described above with reference to FIGS. 1 to 5 is a mechanism that contains a rotary object driven from the drive motor of the watch winder through the transmission components and the multilink mechanism.

Figure 6:
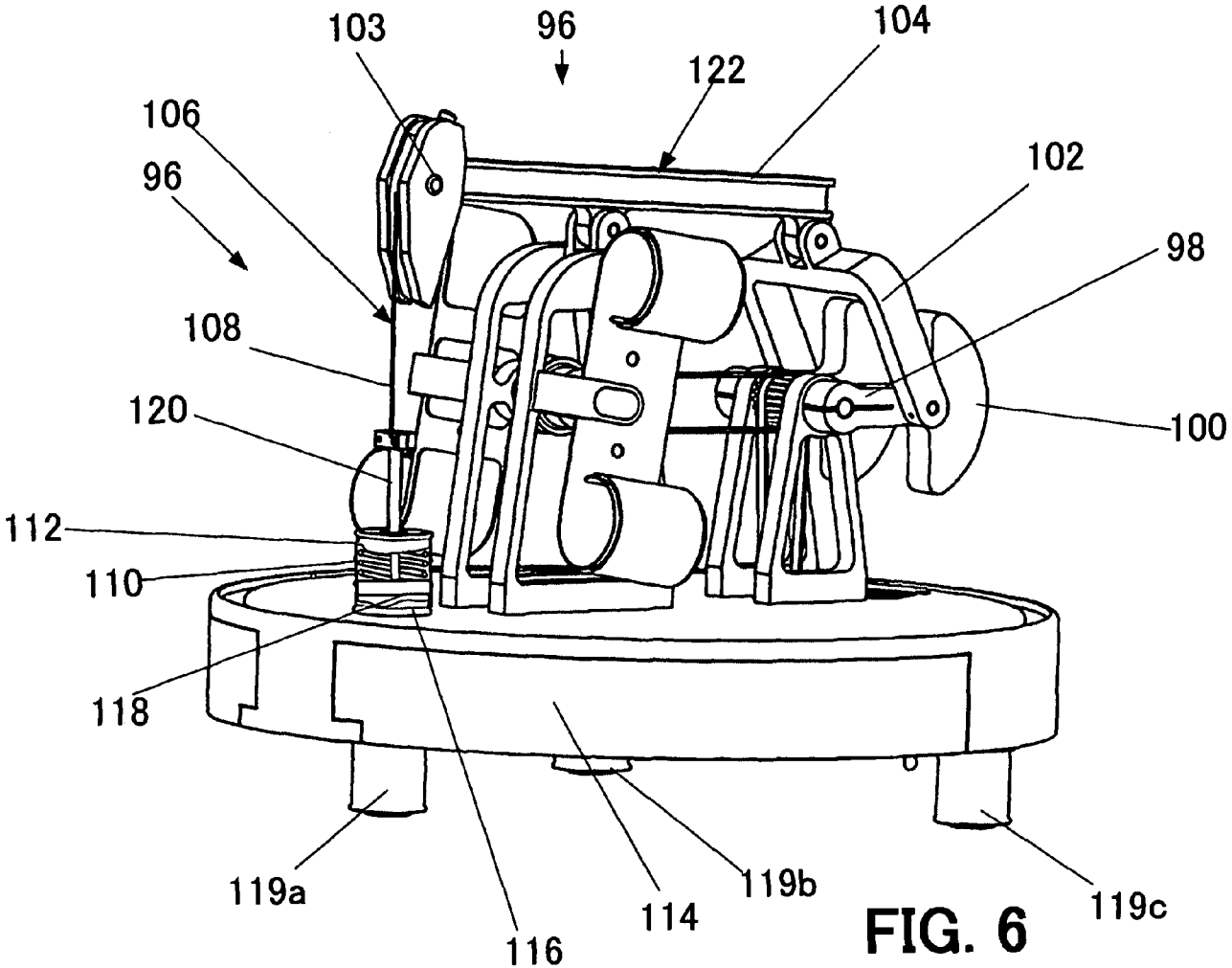
FIG. 6 is a three-dimensional view of the watch winder assembly of the invention with the attention-attracting mechanism formed by the multilink mechanism in the form of an oil-extracting pump.

According to another aspect of the invention, the attraction-attracting mechanism may be formed by the multilink mechanism without the use of a rotary object but rather by implementing the swinging motions of the pivotally connected links of this mechanism. For example, the aforementioned second link, third link, and the support of the third link on the base can be shaped in the form of a swinging oil pump 96, as shown in FIG. 6, wherein the crank 98 may have its free end in the form of counterweights 100, and the first and the second pivotally interconnected links 102 and 104, respectively, accomplish the same function as the respective links of the previously described modification. The end of the second link 104 that is opposite to the end that is connected to the first link 102 is pivotally connected to one end of a third link 106, which is made in the form of a flexible rod 108, one end of which is connected to the second link 104 and another end of which comprises a compression spring 110 that is compressed when the aforementioned other end of the second link moves up and decompresses to assist its downward movement. The spring is retained in a cylindrical body 112 that is attached to the base 114 and is compressed between the closed end 116 of the cylindrical body 112 and a flange 118 of the rigid rod 120 to which the end of the flexible rod 108 is attached. In FIG. 6, base supports are designated by reference numerals 119*a*, 119*b*, and 119*c*. In other words, the third link 106 is connected to the second link 104 and comprises a reciprocating component, one end of which is connected to the end of the third link and the other end of which is resiliently connected to the base.

In this modification the multilink mechanism 122 composed of pivotally connected links is shaped as an oil extraction pump, wherein the crank 98 has its free end in the form of counterweights 100. The first link 102 imitates the Pitman arm, the second link 104 imitates a walking beam, the end of the walking beam 102 may be shaped as a horse head 103, and the third link 106 has a part that imitates a horse head connected with the reciprocating rigid rod 120 (polished rod of the pump) by means of a flexible rod (108 bridle of the pump). In fact, the moving attention-attracting mechanism of the second modification cinematically is the same as the mechanism of the first modification that is used for driving a human-like figure, except that the multilink mechanism contains three pivotally interconnected links instead of two.

In the modification of FIG. 6, the base 114, the drive motor, the motor control, the drive belts, and the watch winder are the same as those described with reference to FIGS. 1 through 5.

Although the invention has been described with reference to specific examples and drawings, it is understood that these examples and drawings should not be construed as limiting the application of the invention and that any changes and modifications are possible without departure from the scope of the attached patent claims. For example, the attention-attracting mechanism can be made in the form of an animal or a fancy figure. The rotating Ferris wheel can be replaced by a propeller, merry-go-round, or another rotating object. The base may have a rectangular or a square shape. The multilink mechanism can be composed of four or five links.

The invention claimed is:

1. A watch winder assembly comprising a watch winder and a moveable attention-attracting mechanism driven from the watch winder through a transmission mechanism, wherein the moveable attention-attracting mechanism comprises a multilink mechanism composed of pivotally connected links that move when the watch winder rotates; the watch winder assembly further comprising a base that supports the watch winder and the multilink mechanism, wherein the multilink mechanism comprises a crank driven from rotation from the watch winder, a first link having one end pivotally connected to the crank, and a second link, one end of which is pivotally connected to the other end of the first link and the other end of which is pivotally connected to the base.

2. The watch winder assembly of claim 1, wherein the multilink mechanism is made in the form of a human being and wherein the first link is made in the form of hands, the second link is made in the form of a body, and the base is provided with a support component that is rigidly connected to the base and is made in the form of legs to which said other end of the second link is pivotally connected so that movement of the multilink mechanism imitates a human being driving the mechanism by rotating the crank.

3. The watch winder assembly of claim 2, further comprising a rotating attention-attracting component that is cinematically connected to the crank and has means for receiving rotation from the crank.

4. The watch winder assembly of claim 3, wherein the rotating attention-attracting component is made in the form of a Ferris wheel and said means for receiving rotation from the crank comprise the belt transmission.

5. The watch winder assembly of claim 3, wherein the watch winder has a drive motor and the base is made hollow and has an interior that contains the drive motor of the watch winder and further comprises retractable drawers located in said interior and retractable outward from the interior of the base.

6. The watch winder assembly of claim 3 further comprising a transparent cover installed on the base and covering the watch winder and moveable attention-attracting mechanism.

7. The watch winder assembly of claim 1, wherein the watch winder has a drive motor and the base is made hollow and has an interior that contains the drive motor of the watch winder and further comprises retractable drawers located in said interior and retractable outwards from the interior of the base.

8. The watch winder assembly of claim 7 further comprising a transparent cover installed on the base and covering the watch winder and moveable attention-attracting mechanism.

9. The watch winder assembly of claim 4, wherein the watch winder has a drive motor and the base is made hollow and has an interior that contains the drive motor of the watch winder and further comprises retractable drawers located in said interior and retractable outward from the interior of the base.

10. The watch winder assembly of claim 1 further comprising a transparent cover installed on the base and covering the watch winder and moveable attention-attracting mechanism.

11. The watch winder assembly comprising a watch winder and a moveable attention-attracting mechanism driven from the watch winder through a transmission mechanism, wherein the moveable attention-attracting mechanism comprises a multilink mechanism composed of pivotally connected links that move when the watch winder rotates; the watch winder assembly further comprising a base that supports the watch winder and the multilink mechanism, wherein the multilink mechanism comprises: a crank driven from rotation from the watch winder; a first link having one end pivotally connected to the crank; a second link, one end of which is pivotally connected to the other end of the first link; a third link, one end of which is connected to the other end of the second link; and a reciprocating component, one end of which is connected to the other end of the third link and the other end of which is resiliently connected to the base.

12. The watch winder assembly of claim 11, wherein the multilink mechanism is shaped as an oil-extraction pump, wherein the end of the crank is formed as counterweights, the first link imitates the Pitman arm, the second link imitates a walking beam, and the end of the walking beam is shaped as a horse head connected to said third link.

13. The watch winder assembly of claim 12, wherein the watch winder has a drive motor and the base is made hollow and has an interior that contains the drive motor of the watch winder and further comprises retractable drawers located in said interior and retractable outward from the interior of the base.

14. The watch winder assembly of claim 12, further comprising a transparent cover installed on the base and covering the watch winder and moveable attention-attracting mechanism.

15. The watch winder assembly of claim 11, wherein the watch winder has a drive motor, and the base is made hollow and has an interior that contains the drive motor of the watch winder and further comprises retractable drawers located in said interior and retractable outward from the interior of the base.

16. The watch winder assembly of claim 11, further comprising a transparent cover installed on the base and covering the watch winder and moveable attention-attracting mechanism.

* * * * *